US006298650B1

(12) United States Patent
Amundsen et al.

(10) Patent No.: US 6,298,650 B1
(45) Date of Patent: Oct. 9, 2001

(54) EASY ADJUSTABLE SNAP LINK

(75) Inventors: Samantha Amundsen, McKinney, TX (US); Fung Chi Sun, Hong Kong (CN); Daniel M. Smith, McKinney, TX (US)

(73) Assignee: Fossil, Inc., Richardson, TX (US)

( * ) Notice: Subject to any disclaimer, the term of this patent is extended or adjusted under 35 U.S.C. 154(b) by 0 days.

(21) Appl. No.: 09/583,367

(22) Filed: May 31, 2000

Related U.S. Application Data

(60) Provisional application No. 60/137,814, filed on Jun. 4, 1999.

(51) Int. Cl.[7] ..... F16G 15/04
(52) U.S. Cl. ..... 59/80; 59/84; 59/85; 63/4
(58) Field of Search ..... 59/80, 78, 84, 59/85; 63/4, 5

(56) References Cited

U.S. PATENT DOCUMENTS

| | | | | |
|---|---|---|---|---|
| Re. 25,163 | | 4/1962 | Manne . | |
| 1,405,851 | | 2/1922 | Lewis . | |
| 1,626,139 | | 4/1927 | Kraysler . | |
| 1,750,786 | | 3/1930 | Roy . | |
| 1,830,187 | | 11/1931 | Ballavance . | |
| 1,923,201 | * | 8/1933 | Hedfors | 59/80 |
| 1,943,733 | | 1/1934 | Kestenman . | |
| 2,417,289 | * | 3/1947 | Bisso et al. | 59/80 |
| 2,518,163 | * | 8/1950 | Megar | 59/80 |
| 2,539,891 | * | 1/1951 | Carr et al. | 59/80 |
| 3,673,794 | * | 7/1972 | I'Anson | 59/35 |
| 4,269,026 | | 5/1981 | Bulle et al. . | |
| 4,606,732 | | 8/1986 | Lyman . | |
| 5,689,947 | | 11/1997 | Yoo . | |
| 5,806,343 | | 9/1998 | Yoo . | |

* cited by examiner

*Primary Examiner*—David Jones
(74) *Attorney, Agent, or Firm*—Strasburger & Price, LLP; John G. Fischer

(57) ABSTRACT

The present disclosure provides a secure yet easily adjustable link design for use in interconnected link jewelry and watches. A link for a bracelet is disclosed that allows for easy adjustment in the length of the bracelet, utilizing a bar and spring system. To remove a link from the bracelet, the links must be at approximately a right angle, force must be applied outwardly to the link with the spring from which a bar is to be removed, and the links easily separate. Similarly to couple links, the links must be at approximately a right angle. When the links are at approximately a right angle, the bar of the first link can enter the spring of the second link. When the links are at any other angle, the bar is secured in the spring and cannot be removed or dislodged. The disclosed bar and spring system allows for a secure yet easily adjustable link system.

48 Claims, 7 Drawing Sheets

EASY ADJUSTABLE SNAP LINK

CROSS-REFERENCES

This application claims the benefits of the earlier filed U.S. Provisional App. Ser. No. 60/137,814 filed on Jun. 4, 1999, which is incorporated by reference for all purposes into this application.

BACKGROUND OF THE INVENTION

1. Field of the Invention

This invention is directed to a link and link assembly for item of jewelry such as a necklace or bracelet, and more particularly to a link assembly for a bracelet having a new spring coupling assembly that facilitates easy coupling and uncoupling of links to attach a bracelet or to shorten and lengthen the bracelet without the need for special tools or expertise.

2. Description of the Related Art

Interconnected links for jewelry-type bracelets and bands have been used for many years in the watch industry. The bracelet links can be connected by screw fittings where the screw holds the links together and acts as a pivot pin or other rotation point for the links. Numerous problems arise as a result of the connections between adjacent links when bracelets need to be lengthened or shortened. One disadvantage of the previously known devices is that the screws of such assemblies frequently loosen as a result of repeated pivoting, and may fall out, resulting in either loss of the watch or the need for repair. Another disadvantage of the previously known devices is that it is time consuming to make adjustments to the length of the bracelet. Another disadvantage of the previously known devices is that special tooling, and, likely, a trip to the jewelers, is required to adjust the length of the bracelet. Another disadvantage of the previously known devices is that because special tooling or a jeweler expertise is required to make the adjustment, the owner may not be able to make the adjustment at the time and place desired. Another disadvantage of the previously known devices is that because special tooling or a jeweler is required to make the adjustment, it may cost money every time an adjustment is made.

Instead of screws, some interconnected link bracelets use pins fitted into slots or bores in the links, such as the system disclosed in U.S. Pat. No. 4,269,026. Unlike the screw fittings, the pins usually do not have a tendency to loosen or fall out However, adjusting the bracelet length is still difficult, and the design otherwise suffers from all of the other disadvantages listed above.

Lastly, plastic bracelets have been made that snap together, relying on the ductility of the plastic to flex over plastic bar portions. These devices are limited in application to children's watches, toy bracelets and the like, since they lack the esthetic appeal, durability, and value of standard jewelry quality bracelets.

SUMMARY

The present invention provides a secure yet easily adjustable bracelet link design for use in interconnected link jewelry and watches that overcomes all of the foregoing problems. One advantage of a preferred embodiment of the present invention is that it does not require or utilize screw assemblies that may loosen or fall out as a result of repeated pivoting, and thus resulting in either loss of the bracelet or watch or the need for repair. Another advantage of a preferred embodiment of the present invention is that adjustments to the length of the bracelet can be made quickly. Another advantage of a preferred embodiment of the present invention is that there is no requirement for special tooling, or a trip to the jewelers to adjust the length of the bracelet. Another advantage of a preferred embodiment of the present invention is that adjustments can be made at any time and place of convenience to the owner, without having to travel to a jeweler during business hours. Another advantage of a preferred embodiment of the present invention is that there is no cost associated with making adjustments to the length. Another advantage of a preferred embodiment of the present invention is that the device can be manufactured from any metal or other material chosen to provide the desired esthetic appeal, durability, and value.

Other advantages of the present invention will become apparent from the following descriptions, taken in connection with the accompanying drawings, wherein, by way of illustration and example, an embodiment of the present invention is disclosed.

In a preferred embodiment, a link for a bracelet that allows for easy attachment and detachment to an adjacent link of similar design is disclosed. The link has a central portion with a laterally disposed cavity. A slot connects the cavity to the external surface of the central portion. Two spaced apart outer portions are attached to one end of the central portion and are connected by a crossbar. A spring clip is located inside the cavity. The spring clip has a spring opening along its length positioned in alignment with the slot. In this position, the crossbar of an adjacent link may be pressed into the opening of the spring clip, causing it to expand for passage of the crossbar into the center of the spring clip.

In a more preferred embodiment, the crossbar has a long cross-sectional axis and a short cross-sectional axis with the long axis in approximately the same plane as the link. In the more preferred embodiment, the spring opening may be expanded to allow passage of the short axis, but expansion is limited to prevent passage of the long axis. In this preferred embodiment, to remove a link from the bracelet, two links are aligned at approximately a 90° (degree) angle, and a force is applied outwardly to the link, away from the cavity from which a crossbar is to be removed, and the links easily separate. The force must be sufficient to expand the spring clip beyond the width of the short axis of the crossbar. Similarly, to couple links, the links are aligned at approximately a 90° (degree) angle so that the crossbar of the first link can enter the cavity of the second link. When the links are at other angles, the crossbar is secured in the cavity and cannot be removed or dislodged. The present invention's crossbar and cavity system allows for a secure yet easily adjustable link system In another preferred embodiment, a bracelet is disclosed having a first link and a second link. The first link has a central portion with a lateral cavity and a slot connecting the cavity to the external surface of the central portion. A spring clip is located inside the cavity. The spring clip has a spring opening along its length positioned in alignment with the slot. The second link has two outer portions connected by a crossbar. The crossbar of the second link may be pressed into the opening of the spring clip, causing it to expand for passage of the crossbar into the center of the spring clip. In a more preferred embodiment, the crossbar has a long cross-sectional axis and a short cross-sectional axis with the long axis in approximately the same plane as the outer portions. In the more preferred embodiment, the spring opening may be expanded to allow passage of the short axis, but expansion is limited to prevent passage of the long axis.

These and other features, aspects, and advantages of the invention will become better understood with regard to the following description, appended claims, and accompanying drawings.

BRIEF DESCRIPTION OF THE DRAWINGS

To further aid in understanding the invention, the attached drawings help illustrate specific features of the invention. The following is a brief description of the attached drawings.

DETAILED DESCRIPTION OF THE INVENTION

The present invention comprises a method and apparatus for an easily adjustable link bracelet. This disclosure describes numerous specific details that include specific structures in order to provide a thorough understanding of the present invention. One skilled in the art will appreciate that one may practice the present invention without these specific details.

Figure 1:
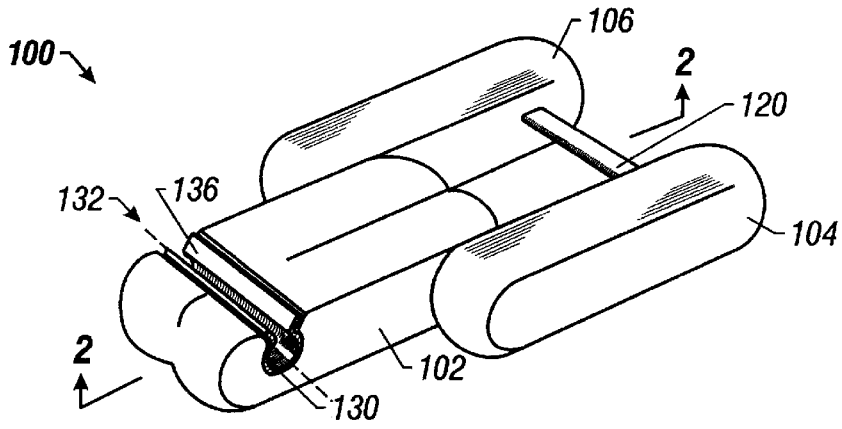
FIG. 1 is a perspective view of a preferred embodiment of the present invention.

A preferred embodiment of the present invention is an easily adjustable link, such as might be used in a watch bracelet. FIG. 1 is an isometric view of a preferred embodiment of a link 100. Link 100 has a central portion 102. A first outer portion 104 and a second outer portion 106 are spaced apart and attached to one end of central portion 102. In the preferred embodiment shown, central portion 102 and outer portions 104 and 106 lie in approximately the same plane. As can best be seen in FIG. 2, and also in FIG. 4, a cavity 110 is laterally disposed in central portion 102. A slot 112 connects cavity 110 with the external surface of central portion 102. In a preferred embodiment, slot 112 is further comprised of a first slot face 114 and an opposing second slot face 116. In a preferred embodiment shown in FIG. 4, first slot face 114 and second slot face 116 form an included face angle 118. In a still more preferred embodiment, face angle 118 is in the approximate range of between about 70 degrees and about 90 degrees. In the most preferred embodiment, face angle 118 is approximately 80 degrees.

Referring back to FIG. 1, a crossbar 120 is attached between first outer portion 104 and second outer portion 106. In a preferred embodiment, crossbar 120 is generally rectangular. In a more preferred embodiment shown in FIG. 1 and again in FIG.2, crossbar 120 is generally oblong. In another preferred embodiment that can best be seen in FIG. 2, crossbar 120 has a short cross-sectional axis 122 and a generally perpendicular long cross-sectional axis 124. In a still more preferred embodiment, long axis 124 lies in a plane that is within about 20° degrees of parallel alignment with the plane of link 100. In the most preferred embodiment, long axis 124 lies in a plane that is approximately parallel in alignment with the plane of link 100.

Figure 3:
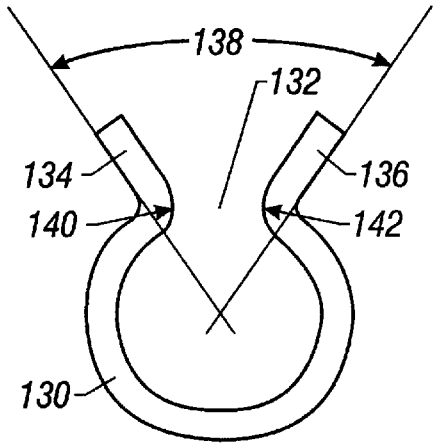
FIG. 3 is a side view of a spring member component of a preferred embodiment of the present invention as shown in FIG. 1.

Referring again to FIG. 1., in a preferred embodiment, a generally cylindrical spring clip 130 is located within cavity 110. A longitudinal spring opening 132 extends the length of spring clip 130. In a more preferred embodiment as best seen in FIG. 3, a first spring lip 134 and an opposing second spring lip 136 are formed along the edges of spring opening 132. Spring lips 134 and 136 and positioned in alignment within slot 112. In another preferred embodiment, spring clip 130 is made of a stainless steel material. For example, spring clip 130 has been successfully made of stainless steel at a thickness of 0.20 millimeters.

In a preferred embodiment, spring lips 134 and 136 form an external angular entry for receiving a crossbar substantially the same as crossbar 120. In a more preferred embodiment that is best seen in FIG. 3, spring lips 134 and 136 form an included lip angle 138. In a still more preferred embodiment, lip angle 138 is in the approximate range of between about 60 degrees and about 80 degrees. In a still more preferred embodiment, lip angle 138 is approximately 70 degrees. In a still more preferred embodiment, lip angle 138 is in the approximate range of between about 5 degrees and about 15 degrees less than face angle 118. In the most preferred embodiment, lip angle 138 is approximately 10 degrees less than face angle 118. In another preferred embodiment that is best seen in FIG. 3, first lip 134 is attached to spring clip 130 by a first inner radius 140, and second lip 136 is attached to spring clip 130 by a second inner radius 142. In a more preferred embodiment, first inner radius 140 and second inner radius 142 are approximately 0.3 millimeters.

In a preferred embodiment, expansion of spring opening 132 is limited by interference between the expanding cylindrical body of spring clip 130 and cavity 110. In a more preferred embodiment, expansion of spring opening 132 is limited by interference between the spring clip 130 and slot 112. In a still more preferred embodiment, expansion of spring opening 132 is limited by interference between the spring lips 134 and 136 and slot 112. In a still more preferred embodiment that is best seen in FIG. 5B, the expansion of spring clip 130 is limited by interference of spring lips 134 and 136 with slot faces 114 and 116 respectively.

Figure 11:
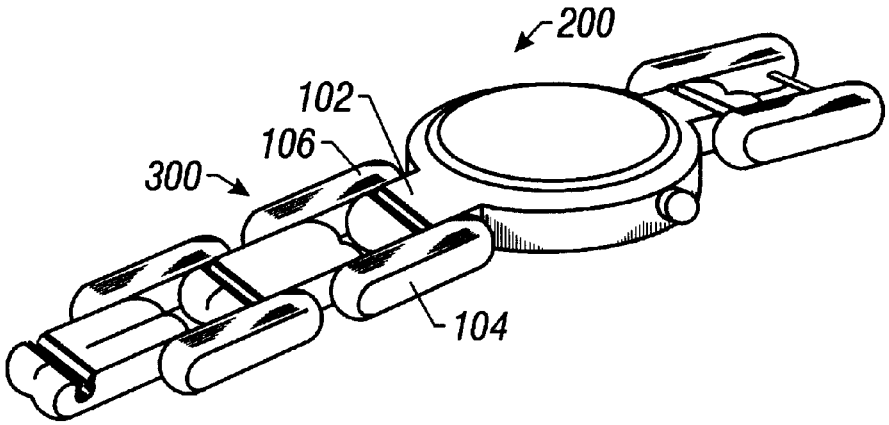
FIG. 11 is a perspective view of a preferred embodiment of the present invention, shown connected in series to like sections and used in a watch application.

An alternative embodiment of the present invention is shown in FIG. 11. In this preferred embodiment, the basic components of link 100 are located on opposing portions of a bracelet or watch for adjacent connection. A watch or other first bracelet section 200 has extending from it central portion 102. Not clearly visible in FIG. 11, but included in first bracelet section 200 in the same general configuration and preferred embodiments as described above, are cavity 110, slot 112, first slot face 114, second slot face 116, face angle 118, spring clip 130, spring opening 132, first lip 134, second lip 136. Also in this alternative preferred embodiment is a second bracelet section 300 opposing section 200, and having the remaining design components of link 100, including first outer portion 104, and second outer portion 106. Not clearly visible in FIG. 11, but included in second bracelet section 300 in the same general configuration and preferred embodiments as described above, are crossbar 120, short axis 122, and long axis 124. In this configuration, it can be seen that the crossbar and spring system that has been described for link 100, can be segregated to function identically as described above for latching or clasping together a watch or bracelet. Also from FIG. 11, it can be seen that the first disclosed embodiment and above disclosed alternative embodiment may be combined in a single bracelet, watch of other jewelry item.

Operation

The present invention provides link 100 that allows for easy addition or removal of extra link 100 members for adjustment of a bracelet or watchband to any desired length without the use of tools. In an alternative embodiment, the component design of link 100 may be used to create a latching clasp mechanism for a bracelet or watchband.

Link 100 as shown in FIG. 1 consists of central portion 102 attached between a first outer section 104 and a second outer section 106. Central portion 102 has a generally cylindrical cavity 110 extending across its width. Slot 112 connects cavity 110 to the external surface of central portion 102. Slot faces 114 and 116 form face angle 118 whose vertex is located inside cavity 110.

Figure 2:
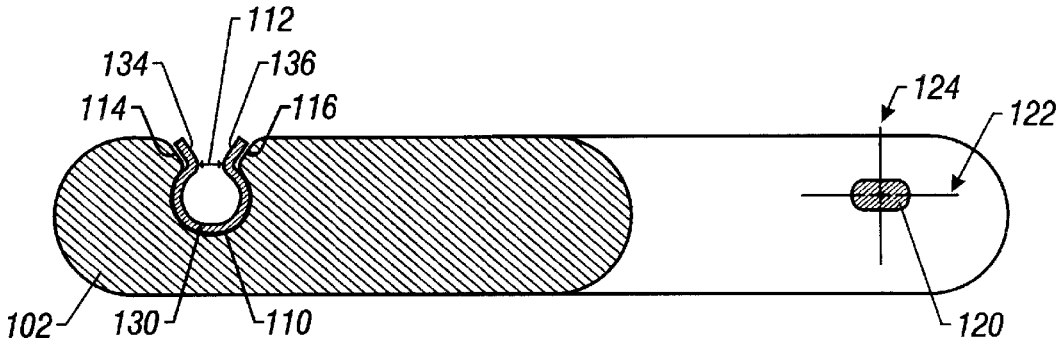
FIG. 2 is a cross-sectional side view of a preferred embodiment of the present invention as shown in FIG. 1.
Figure 4:
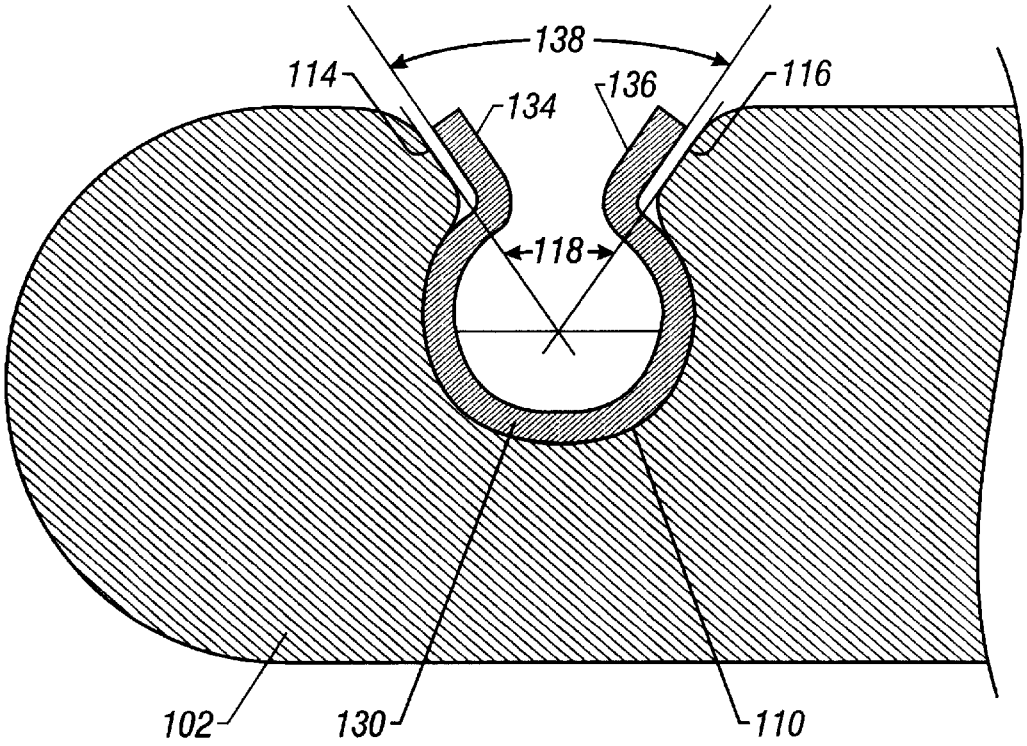
FIG. 4 is a close-up of the relationship between the spring member and cavity shown in FIG. 2.

As can be best seen in FIG. 4, spring clip 130 is generally cylindrical, and has opposing spring lips 134 and 136 defining lip angle 138 with a vertex at the same point as the vertex of face angle 118. As seen in FIG. 1 and FIG. 2, spring member 130 sits snuggly inside cavity 110. In this location, spring lips 134 and 136 are positioned between slot faces 114 and 116 so as to align spring opening 132 with slot 112. In a preferred embodiment that is best seen in FIG. 4, lip angle 138 is less than face angle 118 so that between spring lips 134 and 136 and slot faces 114 and 116, there is a clearance. This clearance allows for a slight expansion of spring opening 132. At the same time, the expansion of spring opening 132 is limited by interference of spring lips 134 and 136 with slot faces 114 and 116.

It should be appreciated that the same result can be obtained by equivalent means such as locating the vertex of a larger lip angle 138 slightly above the vertex of face angle 118.

Outer sections 104 and 106 are connected by crossbar 120 on the end opposite to their connection to central portion 102. In the preferred embodiment shown in FIG. 2, crossbar 120 has a short cross-sectional axis 122 and a long cross-sectional axis 124.

Figure 5A:
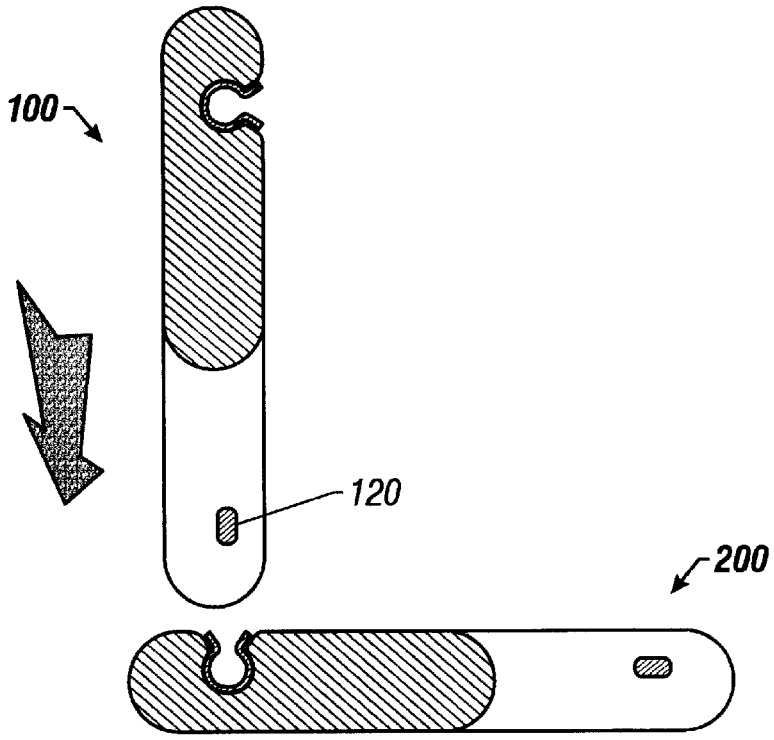
FIG. 5A is a cross-sectional side view of he first step in joining of links, according to a preferred embodiment of the present invention. In this step, the links to be joined are oriented at approximately a right angle. This aligns the short axis of the crossbar of the first link with the spring opening of the second link.
Figure 5B:
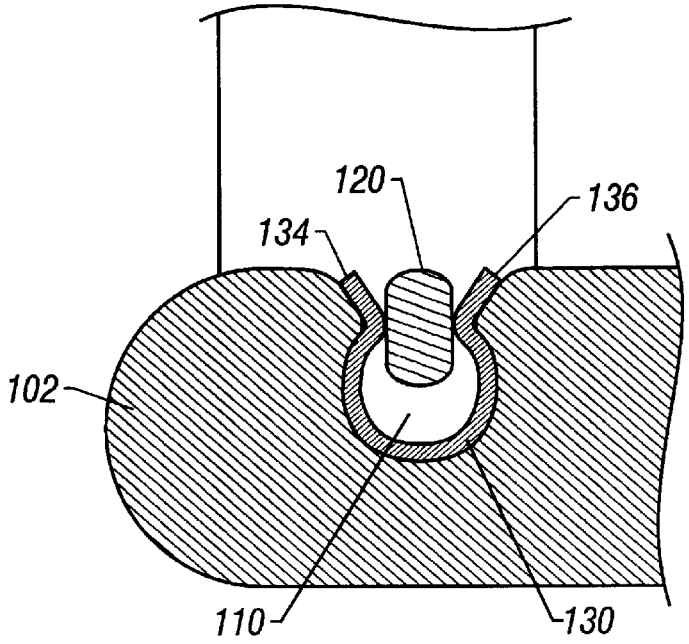
FIG. 5B is a close-up cross-sectional side view of the second step in joining of links, according to a preferred embodiment of the present invention. In this step, the links to be joined are oriented at approximately a right angle, and force has been applied to the first link to expand the spring opening a sufficient distance to allow insertion of the crossbar into the interior of the spring member.
Figure 6:
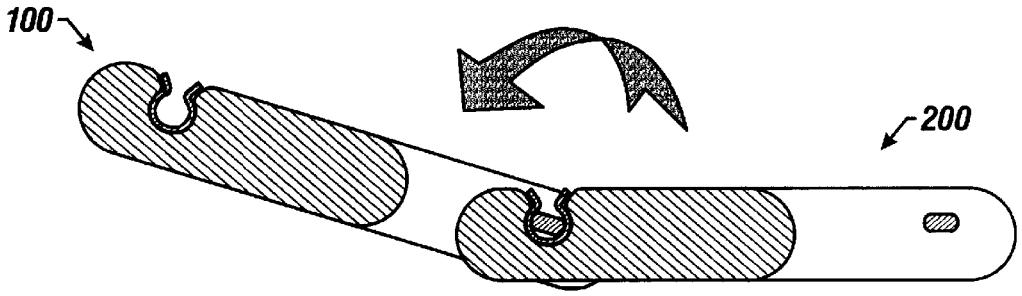
FIG. 6 is a cross-sectional side view of the third step in joining of links, according to a preferred embodiment of the present invention, following the step of FIG. 5B. In this view, the crossbar has pushed past the spring opening, after which time, the first link is then rotated out of right angle orientation with the second link.

The connection of like sections of link 100 can be seen in stepwise procedure as shown in FIG. 5, FIG. 5A, and FIG. 6. FIG. 5A is a cross-sectional side view of the first step in joining link 100 to a link 200 of the same general design. In this step, link 100 is oriented at approximately a right angle to link 200. This aligns short axis 122 of crossbar 120 of link 100 with spring opening 132 of link 200.

FIG. 5B is a close-up cross-sectional side view of the second step in joining of links, according to a preferred embodiment of the present invention. In this step, link 100 is placed in contact with link 200. The point of contact between link 100 and link 200 is at the intersection of crossbar 120 with spring lips 134 and 136. The angular relationship of first spring lip 134 to second spring lip 136 facilitates the centralized alignment of short axis 122 with spring opening 132. As a slight opposing force is applied to link 100 in the direction of link 200, and to link 200 in the direction of link 100, spring opening 132 expands a sufficient distance to allow insertion of the crossbar 120 into the interior of spring member 130. The angular relationship of first spring lip 134 to second spring lip 136, in combination with the radiuses on the edges of crossbar 120, create a horizontal component of force that expands spring opening 132.

As can further be seen in FIG. 5B, expansion of spring opening 132 is limited by interference of spring lips 134 and 136 with slot faces 114 and 116 respectively. This design allows insertion and removal of crossbar 120 into spring clip 130 only when crossbar 120 is substantially oriented so as to engage short axis 122 with spring opening 132. In this manner, adjacent links 100 and 200 cannot be connected or disconnected unless links 100 and 200 are so oriented. In a preferred embodiment, long axis 124 of crossbar 120 is in approximately the same plane as link 100, thus requiring link 100 and link 200 to be in approximately perpendicular orientation to be successfully connected or disconnected.

FIG. 6 is a cross-sectional side view of the final step in joining of link 100 and link 200, following the step of FIG. 5B. In this view, crossbar 120 has been pushed past spring opening 132, after which time, link 100 is rotated out of right angle orientation with link 200. In this view, it can be seen that the orientation of link 100 to link 200 prohibits disconnection, since spring clip 130 cannot be expanded sufficiently to allow removal of crossbar 120 in this position.

Figure 7:
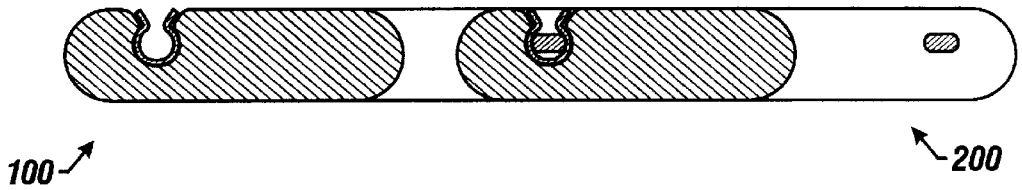
FIG. 7 is a cross-sectional side view of the final step in joining of links, according to a preferred embodiment of the present invention. In this view, the links are in the same plane.

FIG. 7 is a cross-sectional side view of the connected links 100 and 200, showing the link 100 and link 200 in horizontal alignment. It is again clear in this view that the orientation of link 100 to link 200 prohibits disconnection, since spring clip 130 cannot be expanded sufficiently to allow removal of crossbar 120 in this position.

Figure 8:
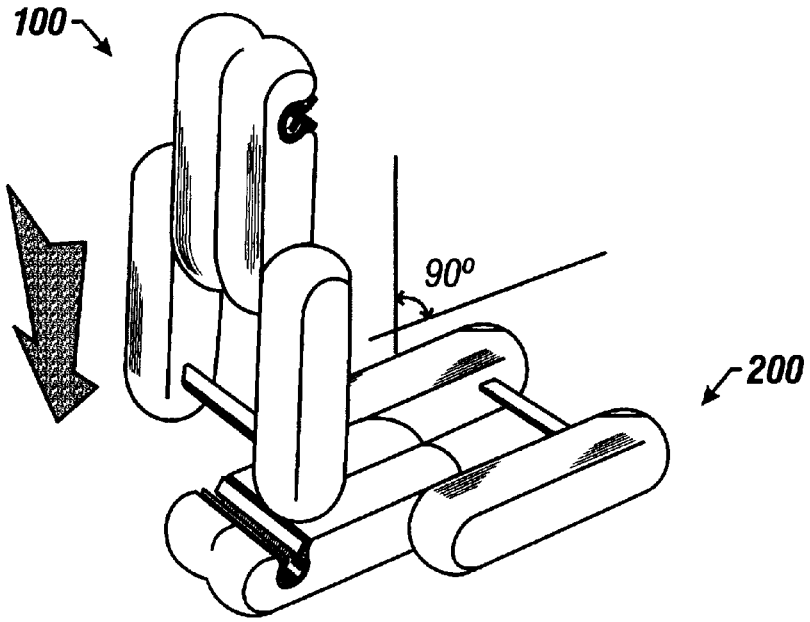
FIG. 8 is a perspective side view of the first step in joining of links, as also shown in FIG. 5.
Figure 9:
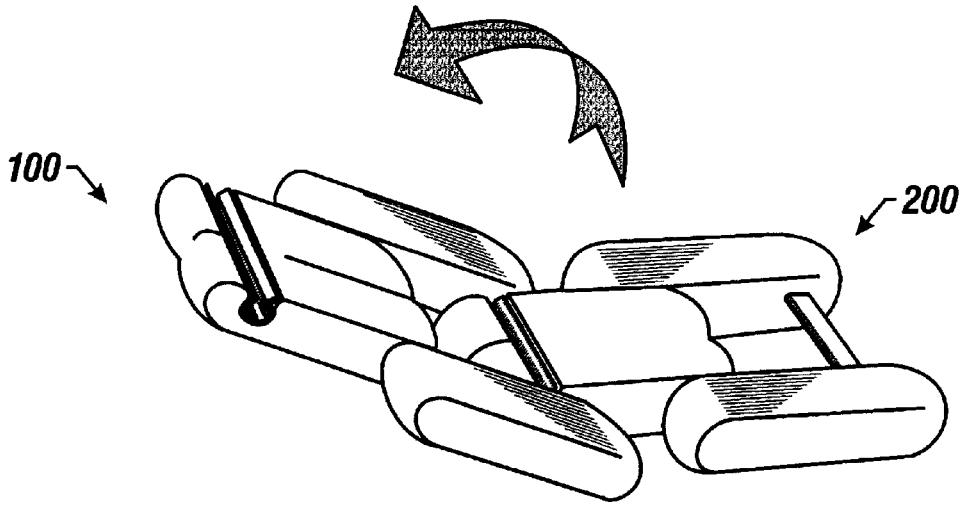
FIG. 9 is a perspective side view of the third step in joining of links, as also shown in FIG. 6.

FIG. 8 and FIG. 9 are perspective side views of the first and final steps in joining of link 100 and link 200, as was also shown in FIG. 5A and FIG. 6 respectively.

Disconnection of the link 100 from link 200 is achieved by performance of the above-described steps of assembly in reverse order. Therefore, to disconnect link 100 form link 200, link 100 must first be placed in approximately perpendicular orientation to link 200. Referring back to FIG. 5B it can be seen that inner radius 140 and inner radius 142 will engage short axis 122 of crossbar 120 in a manner that The point of contact between link 100 and link 200 is at the intersection of crossbar 120 and inner radii 140 and 142.

The relationship of first inner radius 140 to second inner radius 142 facilitates the centralized alignment of short axis 122 with spring opening 132. As a slight opposing force is applied to link 100 away from link 200, and to link 200 away from link 100, spring opening 132 expands a sufficient distance to allow removal of the crossbar 120 from the interior of spring member 130. The relationship of first inner radius 140 to second inner radius 142, in combination with the radiuses on the edges of crossbar 120, create a horizontal component of force that expands spring opening 132, and allows removal of crossbar 120.

Figure 10:
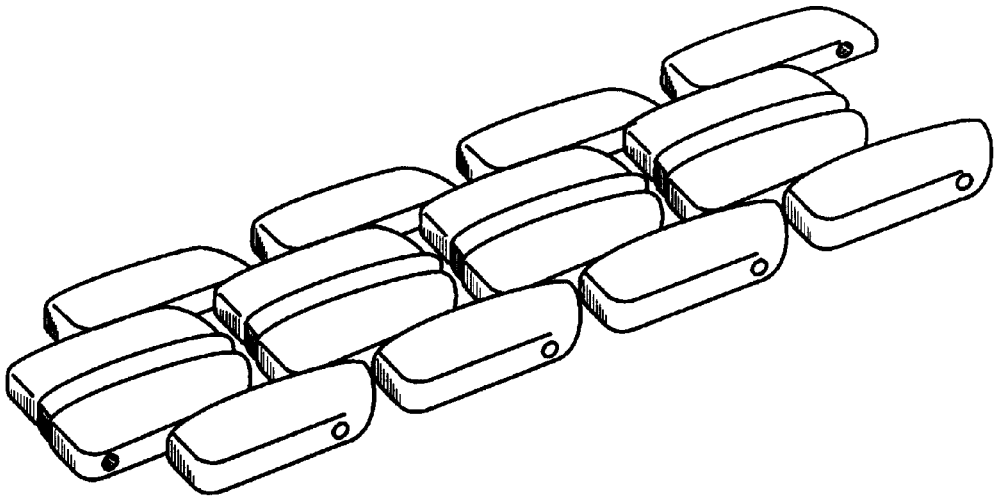
FIG. 10 is a perspective view of a preferred embodiment of the present invention shown connected in series to like sections to form a bracelet.

FIG. 10 is a perspective view of multiple sections of link 100 connected in series to form a section or entire length of a bracelet.

FIG. 11 is a perspective view of an alternative embodiment in which the design components of link 100 are located on opposing portions of a bracelet or watch adjacent connection. In this alternative preferred embodiment, a watch or other first bracelet section 200 has extending from it central portion 102, cavity 110, slot 112, first slot face 114, second slot face 116, face angle 118, spring clip 130, spring opening 132, first lip 134, second lip 136. Also in this alternative preferred embodiment is a second bracelet section 300 opposing first section 200, and having the remaining design components of link 100, including first outer portion 104, second outer portion 106, crossbar 120, short axis 122, and long axis 124. In this configuration, it can be seen that the crossbar and spring system that has been described for link 100, can be segregated to function identically as described above for latching or clasping together a watch or bracelet.

In the first step of latching the bracelet of the alternative preferred embodiment, first section 200 is oriented at approximately a right angle to second section 300. This aligns short axis 122 of crossbar 120 of first section 200 with spring opening 132 of second section 300.

In the second step of latching the bracelet, first section 200 is placed in contact with second section 300. The point of contact between first section 200 and second section 300 is at the intersection of crossbar 120 with spring lips 134 and 136. The angular relationship of first spring lip 134 to second spring lip 136 facilitates the centralized alignment of short axis 122 with spring opening 132. As a slight opposing force is applied to first section 200 in the direction of second section 300 and to second section 300 in the direction of first section 200, spring opening 132 expands a sufficient distance to allow insertion of the crossbar 120 into the interior of the spring member 130. In the final step in joining of first section 200 and second section 300, first section 200 is rotated out of right angle orientation with second section 300.

In this embodiment, interchangeable items of jewelry or interchangeable watches may be inserted within a bracelet without the need for special tools or expertise.

Figure 12:
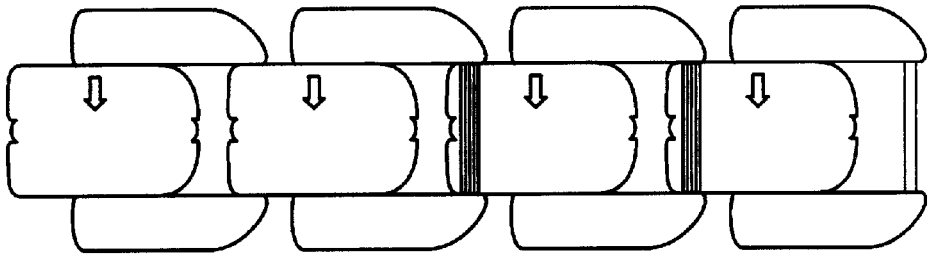
FIG. 12 is a bottom view of links of a preferred embodiment of the present invention shown connected in series to like sections in combination with non-adjustable links of similar dimension and appearance to form a bracelet.
Figure 13:
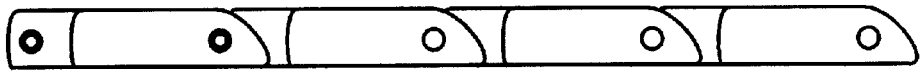
FIG. 13 is a side view of the preferred embodiment shown in FIG. 12.

FIG. 12 is a bottom view of a preferred embodiment of the present invention shown connected in series to like sections in combination with non-adjustable links of similar dimension and appearance to form a bracelet. FIG. 13 is a side view of the preferred embodiment shown in FIG. 12.

To summarize, the disclosed invention is a link for a bracelet that allows for easy adjustment to the length of the bracelet without the need for special tools or expertise, utilizing a crossbar and spring system. An alternative embodiment of the disclosed invention also provides for easy adjacent connection of opposing jewelry and watch sections. The present invention provides a secure yet easily adjustable link design for use in interconnected link jewelry and watches.

Other embodiments of the invention will be apparent to those skilled in the art after considering this specification or practicing the disclosed invention. The specification and examples above are exemplary only, with the true scope of the invention being indicated by the following claims.

We claim:

1. A link for a bracelet, comprising:

a central portion;

a cavity in the central portion;

a slot connected to the cavity;

a pair of spaced apart outer portions, attached to one end of the central portion;

a crossbar attached between the outer portions opposite to the central portion; and a spring clip located inside the cavity, having a spring opening along its length positioned in alignment with the slot.

2. The link of claim 1, further comprising;

wherein the crossbar is generally rectangular.

3. The link of claim 1, further comprising;

wherein the crossbar is generally oblong.

4. The link of claim 1, further comprising;

wherein the cavity is generally cylindrical.

5. The link of claim 1, further comprising;

wherein the spring clip is generally cylindrical.

6. The link of claim 1, further comprising;

wherein the spring clip is made of a stainless steel material.

7. The link of claim 1, further comprising;

wherein expansion of the spring opening is limited by interference between the spring clip and the cavity.

8. The link of claim 1, further comprising;

wherein expansion of the spring opening is limited by interference between the spring clip and the slot.

9. The link of claim 1, further comprising;

wherein the crossbar has a long cross-sectional axis and a short cross-sectional axis.

10. The link of claim 9, further comprising;

wherein the long axis is in a plane approximately parallel to the plane of the central portion.

11. The link of claim 9, further comprising;

wherein the long axis is at least about 10 percent wider than the short axis.

12. The link of claim 9, further comprising;

wherein the spring opening is expandable to a width at least as wide as the short axis.

13. The link of claim 9, further comprising;

wherein the spring opening is expandable to a width less than the long axis.

14. The link of claim 1, further comprising;

a pair of opposing spring lips formed along the edges of the spring opening and extending into the slot.

15. The link of claim 14, further comprising;

wherein the opposing spring lips form a lip angle with a vertex directed generally towards the center of the spring clip.

16. The link of claim 14, further comprising;

wherein expansion of the spring opening is limited by interference between the spring lips and the slot.

17. The link of claim 14, further comprising;

An inner radius between each spring lip and the center of the spring clip.

18. The link of claim 17, further comprising;

wherein the inner radius is approximately 0.3 millimeters.

19. The link of claim 1, further comprising;

a pair of opposing slot faces formed on the slot.

20. The link of claim 19, further comprising;

wherein expansion of the spring opening is limited by interference between the spring lips and the slot faces.

21. The link of claim 19, further comprising;

wherein the opposing slot faces form a face angle with a vertex directed generally towards the center of the cavity.

22. The link of claim 21, further comprising;

wherein the face angle is at least 5° (degrees) larger than the lip angle.

23. The link of claim 21, further comprising;

wherein the face angle is between about 70° (degrees) and about 90° (degrees).

24. The link of claim 21, further comprising;

wherein the face angle is approximately 80° (degrees).

25. A bracelet connection, comprising:

a first bracelet section having a central portion with a cavity, and a slot connected to the cavity;

a spring clip located inside the cavity, having a spring opening along its length positioned in alignment with the slot; and, a second bracelet section having two outer portions and a crossbar attached between the outer portions.

26. The bracelet connection of claim 25, further comprising;

the crossbar is generally rectangular.

27. The bracelet connection of claim 25, further comprising;

wherein the crossbar is generally oblong.

28. The bracelet connection of claim 25, further comprising;

wherein the cavity is generally cylindrical.

29. The bracelet connection of claim 25, further comprising;

wherein the spring clip is generally cylindrical.

30. The bracelet connection of claim 25, further comprising;

wherein the spring is made of a stainless steel material.

31. The bracelet connection of claim 25, further comprising;

wherein expansion of the spring opening is limited by interference between the spring clip and the cavity.

32. The bracelet connection of claim 25, further comprising;

wherein expansion of the spring opening is limited by interference between the spring clip and the slot.

33. The bracelet connection of claim 25, further comprising;

wherein the crossbar has a long cross-sectional axis and a short cross-sectional axis.

34. The bracelet connection of claim 33, further comprising;

wherein the long axis is in a plane approximately parallel to the plane of the central portion.

35. The bracelet connection of claim 33, further comprising;

wherein the long axis is at least about 10 percent wider than the short axis.

36. The bracelet connection of claim 33, further comprising;

wherein the spring opening is expandable to a width at least as wide as the short axis.

37. The bracelet connection of claim 33, further comprising;

wherein the spring opening being expandable to a width less than the long axis.

38. The bracelet connection of claim 25, further comprising;

a pair of opposing spring lips formed along the edges of the spring opening and extending into the slot.

39. The bracelet connection of claim 33, further comprising;

wherein the opposing spring lips form a lip angle with a vertex directed generally towards the center of the spring clip.

40. The bracelet connection of claim 33, further comprising;

wherein expansion of the spring opening is limited by interference between the spring lips and the slot.

41. The link of claim 33, further comprising;

An inner radius between each spring lip and the center of the spring clip.

42. The link of claim 41, further comprising;

wherein the inner radius is approximately 0.3 millimeters.

43. The bracelet connection of claim 27, further comprising;

a pair of opposing slot faces formed on the slot.

44. The bracelet connection of claim 43, further comprising;

wherein expansion of the spring opening is limited by interference between the spring lips and the slot faces.

45. The bracelet connection of claim 43, further comprising;

wherein the opposing slot faces form a face angle with a vertex directed generally towards the center of the cavity.

46. The bracelet connection of claim 45, further comprising;

wherein the face angle is at least 5° (degrees) larger than the lip angle.

47. The bracelet connection of claim 45, further comprising;

wherein the face angle is between about 70° (degrees) and about 90° (degrees).

48. The bracelet connection of claim 45, further comprising;

wherein the face angle is approximately 80° (degrees).

* * * * *